US007036693B2

(12) United States Patent
Walsh et al.

(10) Patent No.: US 7,036,693 B2
(45) Date of Patent: May 2, 2006

(54) PAINT CONTAINER

(75) Inventors: Michael J. Walsh, Chesterfield, MO (US); James N. McDerby, Jr., Fenton, MO (US); Norman Morfeld, High Ridge, MO (US); Cynthia S. Sherrill, Barnhart, MO (US); Stephen L. Crouse, Manchester, MO (US); Douglas W. Newman, St. Charles, MO (US); Jeffrey A. Schutte, University City, MO (US); Mark Gilbertson, Sauk City, WI (US); Scott G. Manke, Sun Prairie, WI (US); Michael Brock, Madison, WI (US)

(73) Assignee: Masterchem Industries LLC, Imperial, MO (US)

( * ) Notice: Subject to any disclaimer, the term of this patent is extended or adjusted under 35 U.S.C. 154(b) by 326 days.

(21) Appl. No.: 10/006,985

(22) Filed: Dec. 5, 2001

(65) Prior Publication Data

US 2003/0102340 A1 Jun. 5, 2003

(51) Int. Cl.
*B65D 25/40* (2006.01)

(52) U.S. Cl. ..... 222/572; 222/566; 222/109; 222/466; 220/731; 220/771; 220/772

(58) Field of Classification Search ..... 222/572, 222/566, 465.1, 571, 561, 568, 466, 143, 222/471.4, 109; 206/504, 509, 508; 220/23.6, 220/23.2, 770–771, 212, 731, 772–776
See application file for complete search history.

(56) References Cited

U.S. PATENT DOCUMENTS

| | | | | |
|---|---|---|---|---|
| 164,128 | A | 6/1875 | Babbit | |
| 1,768,098 | A * | 6/1930 | Aulbach | 222/109 |
| 1,794,098 | A * | 2/1931 | Aulbach | 222/109 |
| 1,952,288 | A | 3/1934 | Saxon | |
| 2,077,027 | A | 4/1937 | Torras | |
| 2,120,487 | A | 6/1938 | Conner | |
| 2,601,039 | A | 6/1952 | Livingstone | |
| 2,690,281 | A | 9/1954 | Livingstone | |
| D174,365 | S | 3/1955 | Wilson | |
| 2,743,844 | A | 5/1956 | Livingstone | |
| 2,763,402 | A | 9/1956 | Livingstone | |
| 2,763,403 | A | 9/1956 | Livingstone | |
| 2,848,142 | A | 8/1958 | Livingstone | |
| 2,851,196 | A | 9/1958 | Livingstone | |
| 2,921,330 | A | 1/1960 | Prytikin | |
| 2,935,223 | A | 5/1960 | Crowley | |

(Continued)

FOREIGN PATENT DOCUMENTS

| | | |
|---|---|---|
| BE | 518014 | 3/1953 |

(Continued)

OTHER PUBLICATIONS

International Search Report, PCT/US02/38952, date of mailing Jul. 14, 2003.

(Continued)

*Primary Examiner*—Frederick Nicolas
(74) *Attorney, Agent, or Firm*—Foley & Lardner LLP

(57) ABSTRACT

A paint container includes a body having a bottom, a plurality of side walls, and a top. An attachment mechanism is located proximate the top. A cap is configured to be secured to the attachment mechanism. A spout extends upward proximate the top and is at least partially surrounded by the attachment mechanism. A channel located between the attachment mechanism and the spout permits paint spilled into the channel to flow back into the paint container.

18 Claims, 10 Drawing Sheets

U.S. PATENT DOCUMENTS

| | | | | | |
|---|---|---|---|---|---|
| 3,085,710 | A | | 4/1963 | McIlroy | |
| 3,138,284 | A | | 6/1964 | Henchert | 220/91 |
| D206,407 | S | | 12/1966 | Sharp | |
| 3,291,295 | A | | 12/1966 | Caligiuri | |
| 3,292,815 | A | | 12/1966 | Smith et al. | |
| 3,298,561 | A | | 1/1967 | McConnie | |
| 3,300,104 | A | | 1/1967 | Burt | 222/482 |
| 3,307,752 | A | | 3/1967 | Anderson | |
| 3,323,691 | A | | 6/1967 | Ruetz | |
| D208,276 | S | | 8/1967 | Moore | |
| 3,387,749 | A | | 6/1968 | Godshalk et al. | |
| 3,451,590 | A | | 6/1969 | Johnson et al. | |
| 3,463,366 | A | | 8/1969 | Spencer | |
| D217,231 | S | | 4/1970 | Pashman | |
| 3,590,416 | A | * | 7/1971 | Henningsen | 15/257.06 |
| 3,727,792 | A | | 4/1973 | Levin | |
| 3,744,671 | A | | 7/1973 | Saunders, Jr. | |
| 3,833,150 | A | | 9/1974 | Visser-Patings | |
| 3,853,249 | A | | 12/1974 | Weir, Jr. et al. | |
| 3,866,791 | A | | 2/1975 | Roper et al. | |
| 3,899,107 | A | | 8/1975 | Gaal | |
| 3,945,527 | A | | 3/1976 | Pylant | |
| 3,972,453 | A | | 8/1976 | Kapples | |
| 3,980,213 | A | | 9/1976 | Ramsay | |
| 4,014,465 | A | | 3/1977 | Ritter | |
| 4,033,473 | A | | 7/1977 | Raley et al. | |
| 4,051,984 | A | | 10/1977 | Ho | |
| 4,061,242 | A | | 12/1977 | Donlon | |
| 4,125,210 | A | | 11/1978 | Embree | |
| 4,150,763 | A | | 4/1979 | Simpson | |
| 4,222,485 | A | | 9/1980 | Focke | 206/141 |
| 4,225,064 | A | | 9/1980 | Westcott | |
| 4,235,348 | A | | 11/1980 | Watson | |
| 4,240,568 | A | | 12/1980 | Pool | 222/189 |
| D258,563 | S | | 3/1981 | Romagnoli | |
| 4,266,686 | A | | 5/1981 | Carter | |
| D261,362 | S | | 10/1981 | Epperson | |
| 4,298,145 | A | | 11/1981 | Iida | |
| 4,335,759 | A | | 6/1982 | Pattiniemi et al. | |
| D267,631 | S | | 1/1983 | Beechuk | |
| 4,387,828 | A | | 6/1983 | Yates, Jr. | |
| 4,399,926 | A | | 8/1983 | Eidels-Dubovoy | |
| 4,440,328 | A | | 4/1984 | De Freitas | 222/538 |
| 4,474,303 | A | | 10/1984 | Maccise | |
| D279,763 | S | | 7/1985 | Hestehave et al. | |
| 4,550,862 | A | | 11/1985 | Barker et al. | |
| 4,583,666 | A | | 4/1986 | Buck | |
| 4,615,456 | A | | 10/1986 | Cousar | |
| 4,632,888 | A | | 12/1986 | Kump et al. | |
| D288,535 | S | | 3/1987 | Bozich | |
| D289,377 | S | | 4/1987 | Ashby et al. | |
| 4,671,421 | A | | 6/1987 | Reiber et al. | |
| 4,696,416 | A | | 9/1987 | Muckenfuhs et al. | |
| D292,489 | S | | 10/1987 | Kowollik et al. | |
| D292,491 | S | | 10/1987 | Kowollik et al. | |
| D292,492 | S | | 10/1987 | Ross et al. | |
| 4,702,395 | A | | 10/1987 | Nitsch | |
| 4,706,829 | A | | 11/1987 | Li | |
| 4,713,064 | A | | 12/1987 | Bruno et al. | |
| 4,736,874 | A | | 4/1988 | Durant | |
| D296,420 | S | | 6/1988 | Frahm et al. | |
| 4,752,543 | A | | 6/1988 | Anderson et al. | |
| D296,671 | S | | 7/1988 | Jordan | |
| 4,771,501 | A | | 9/1988 | Leiter | |
| 4,773,560 | A | | 9/1988 | Kittscher | |
| 4,799,306 | A | | 1/1989 | Collins et al. | |
| 4,805,793 | A | | 2/1989 | Brandt et al. | |
| 4,830,234 | A | | 5/1989 | Odet | |
| D302,526 | S | | 8/1989 | Ritter | |
| 4,865,282 | A | | 9/1989 | Yonkman et al. | |
| D304,014 | S | | 10/1989 | O'Connell | |
| D304,296 | S | | 10/1989 | Wilson et al. | D9/374 |
| 4,890,770 | A | | 1/1990 | Haga et al. | |
| 4,892,207 | A | | 1/1990 | Cullis | 215/100 |
| 4,893,723 | A | | 1/1990 | Seabolt | |
| 4,895,269 | A | | 1/1990 | Cade | |
| 4,895,415 | A | | 1/1990 | Stay et al. | |
| 4,911,319 | A | | 3/1990 | DeJean | |
| 4,917,268 | A | | 4/1990 | Campbell et al. | |
| 4,927,046 | A | | 5/1990 | Armstrong | |
| 4,928,839 | A | | 5/1990 | Kruelskie | |
| 4,941,586 | A | | 7/1990 | Tarna | |
| 4,949,884 | A | | 8/1990 | Dahl | |
| 4,984,714 | A | | 1/1991 | Sledge | |
| 4,993,605 | A | | 2/1991 | Del'Re | |
| 5,012,960 | A | | 5/1991 | Arnold | 222/570 |
| 5,020,699 | A | | 6/1991 | Sams | |
| 5,022,559 | A | | 6/1991 | Condon | |
| D318,228 | S | | 7/1991 | Schlesselman | |
| 5,037,002 | A | | 8/1991 | Tschanen | 222/105 |
| D320,911 | S | | 10/1991 | Carlson | |
| 5,058,772 | A | | 10/1991 | Moore et al. | 222/109 |
| D321,325 | S | | 11/1991 | Petrus | D9/435 |
| D321,624 | S | | 11/1991 | Fiore et al. | |
| 5,065,937 | A | | 11/1991 | Ritter | 229/117.13 |
| D322,221 | S | | 12/1991 | Neff | |
| D323,115 | S | | 1/1992 | Kelsey | |
| D323,456 | S | | 1/1992 | Gonda | |
| 5,078,289 | A | * | 1/1992 | Bolton et al. | 215/228 |
| 5,108,009 | A | | 4/1992 | Davidson et al. | |
| 5,123,576 | A | | 6/1992 | Lawrence | |
| D329,576 | S | | 9/1992 | Desjardin | |
| D331,094 | S | | 11/1992 | Sterett | |
| 5,160,067 | A | | 11/1992 | Luber | 222/109 |
| 5,195,662 | A | | 3/1993 | Neff | |
| 5,207,356 | A | | 5/1993 | Krall | 222/109 |
| 5,234,130 | A | | 8/1993 | Benioff et al. | |
| 5,234,133 | A | | 8/1993 | Kensey | |
| 5,251,788 | A | | 10/1993 | Moore | |
| 5,269,438 | A | | 12/1993 | Kelsey | |
| 5,299,710 | A | | 4/1994 | Welsch et al. | |
| 5,307,956 | A | | 5/1994 | Richter et al. | 222/143 |
| 5,316,054 | A | * | 5/1994 | Hall et al. | 141/22 |
| D347,790 | S | | 6/1994 | Lathrop et al. | |
| 5,320,260 | A | | 6/1994 | Song et al. | |
| D351,792 | S | | 10/1994 | Morris, Sr. | D9/425 |
| 5,377,863 | A | | 1/1995 | Widman | |
| D355,366 | S | | 2/1995 | Bainton | D9/532 |
| 5,400,916 | A | | 3/1995 | Weber | |
| D357,780 | S | | 4/1995 | Breen | D34/10 |
| 5,415,956 | A | | 5/1995 | Ching | |
| 5,435,467 | A | | 7/1995 | Ekkert et al. | |
| D362,180 | S | | 9/1995 | Haines | |
| 5,457,850 | A | | 10/1995 | Knox | |
| 5,469,986 | A | | 11/1995 | Jang | |
| 5,472,111 | A | * | 12/1995 | Renfrew | 220/570 |
| 5,472,121 | A | | 12/1995 | Silano | |
| D368,032 | S | | 3/1996 | Couto | |
| 5,505,331 | A | | 4/1996 | Rathbun | |
| 5,507,543 | A | | 4/1996 | Shefflin | |
| D370,153 | S | | 5/1996 | Chaney et al. | |
| 5,533,802 | A | | 7/1996 | Garganese | |
| 5,547,091 | A | | 8/1996 | Neveras et al. | |
| D374,178 | S | | 10/1996 | Valls et al. | |
| 5,566,861 | A | | 10/1996 | Serano | |
| 5,566,862 | A | | 10/1996 | Haffner et al. | |
| 5,568,879 | A | | 10/1996 | Kovathana | |
| 5,579,556 | A | | 12/1996 | Chung | |
| 5,584,430 | A | | 12/1996 | Mulry | 229/117.16 |
| 5,597,090 | A | | 1/1997 | Leahy | 222/1 |
| D379,302 | S | | 5/1997 | Rodman | |
| 5,626,258 | A | | 5/1997 | Maiorino | |
| 5,641,089 | A | | 6/1997 | Palank | 220/733 |
| 5,649,650 | A | | 7/1997 | Klauke | |

| | | | | |
|---|---|---|---|---|
| 5,662,242 | A | 9/1997 | Steo | |
| 5,669,526 | A | 9/1997 | Keyfauver | |
| 5,678,684 | A | 10/1997 | Wright | |
| 5,683,009 | A | 11/1997 | King | |
| 5,704,506 | A | 1/1998 | Tobias et al. | 215/398 |
| 5,709,314 | A * | 1/1998 | Petry | 220/802 |
| D392,160 | S | 3/1998 | Schmidt | D7/622 |
| D393,520 | S | 4/1998 | Christy | |
| 5,743,445 | A | 4/1998 | Benarrouch | |
| 5,758,886 | A | 6/1998 | Mayer | |
| 5,779,051 | A | 7/1998 | Boutin | 205/504 |
| 5,810,196 | A | 9/1998 | Lundy | |
| 5,823,345 | A | 10/1998 | Nask et al. | |
| 5,855,299 | A | 1/1999 | Arnold et al. | |
| 5,855,304 | A | 1/1999 | Dean et al. | |
| D405,014 | S | 2/1999 | Nask et al. | |
| 5,893,489 | A | 4/1999 | Giarrante | |
| 5,896,993 | A | 4/1999 | Nask et al. | |
| 5,904,269 | A | 5/1999 | Wolff | |
| 5,913,450 | A | 6/1999 | Runkel | |
| 5,921,448 | A | 7/1999 | Stewart | 222/490 |
| 5,927,499 | A | 7/1999 | Vesborg | |
| 5,931,324 | A | 8/1999 | Lyons et al. | 215/398 |
| 5,938,080 | A | 8/1999 | Haaser et al. | |
| 5,941,422 | A | 8/1999 | Struble | |
| D415,597 | S | 10/1999 | Neff | |
| D415,687 | S | 10/1999 | Lai et al. | |
| 5,971,201 | A | 10/1999 | Daw | |
| 5,988,418 | A | 11/1999 | Maeshima | |
| 6,029,858 | A | 2/2000 | Srokose et al. | |
| 6,053,345 | A | 4/2000 | Jones | 215/398 |
| 6,059,153 | A | 5/2000 | Olson et al. | 222/465.1 |
| 6,085,949 | A | 7/2000 | Zimny et al. | |
| D428,763 | S | 8/2000 | Hashimoto | |
| D428,817 | S | 8/2000 | Olson et al. | |
| 6,123,231 | A | 9/2000 | Geisinger | |
| D431,472 | S | 10/2000 | Cain et al. | |
| 6,126,048 | A | 10/2000 | Bublitz | |
| 6,138,853 | A | 10/2000 | Frechette | 220/212.5 |
| 6,138,963 | A * | 10/2000 | Malvasio | 248/111 |
| D435,445 | S | 12/2000 | Arai et al. | |
| 6,179,158 | B1 | 1/2001 | Koda | |
| 6,186,352 | B1 | 2/2001 | Hwang | |
| 6,189,725 | B1 | 2/2001 | Monico | 220/698 |
| 6,209,762 | B1 | 4/2001 | Haffner et al. | |
| 6,210,382 | B1 * | 4/2001 | Hogg | 604/317 |
| 6,223,945 | B1 | 5/2001 | Giblin et al. | |
| 6,234,364 | B1 | 5/2001 | Nybakke et al. | 222/469 |
| D445,684 | S | 7/2001 | Key | |
| 6,269,977 | B1 | 8/2001 | Moore | |
| 6,293,692 | B1 | 9/2001 | Bowsher et al. | 366/130 |
| RE37,518 | E | 1/2002 | Hardigg et al. | |
| D456,259 | S | 4/2002 | Groenewald | |
| 6,367,670 | B1 | 4/2002 | Warner et al. | |
| D458,844 | S | 6/2002 | Shea | |
| 6,398,076 | B1 | 6/2002 | Giblin et al. | 222/109 |
| 6,412,661 | B1 | 7/2002 | Hannah, Sr. | 222/111 |
| D464,879 | S | 10/2002 | Meeker et al. | D9/424 |
| D465,153 | S | 11/2002 | Meeker et al. | D9/424 |
| 6,530,500 | B1 | 3/2003 | Bravo et al. | |
| D474,115 | S * | 5/2003 | Brock et al. | D9/532 |
| 6,588,612 | B1 | 7/2003 | Dorn et al. | 215/10 |
| D478,820 | S | 8/2003 | Walsh et al. | D9/560 |
| D480,973 | S | 10/2003 | Nottingham et al. | |
| 6,896,156 | B1 * | 5/2005 | McDonald et al. | |
| 2002/0195471 | A1 | 12/2002 | Nottingham et al. | |
| 2003/0102339 | A1 | 6/2003 | Walsh et al. | 222/567 |
| 2003/0111489 | A1 | 6/2003 | Bravo et al. | 222/111 |
| 2003/0111497 | A1 | 6/2003 | Lukaris | 224/197 |
| 2003/0121941 | A1 | 7/2003 | Walsh et al. | 222/465.1 |

FOREIGN PATENT DOCUMENTS

| | | | | |
|---|---|---|---|---|
| CA | 972724 | | 8/1975 | 217/61 |
| CA | 2016036 | | 5/1991 | 210/45 |
| DE | 20609963 | | 6/1972 | |
| DE | 4035517 | A1 | 5/1991 | |
| DE | 4123513 | A1 | 1/1993 | |
| EP | 0350142 | A1 | 1/1990 | |
| EP | 0301986 | B1 | 1/1992 | |
| EP | 0 599 028 | B1 | 6/1994 | |
| EP | 0641676 | B1 | 3/1995 | |
| EP | 0486107 | B1 | 6/1995 | |
| EP | 0960055 | B1 | 12/1999 | |
| GB | 528486 | | 10/1940 | |
| GB | 2110637 | | 6/1983 | |
| GB | 2166706 | | 5/1986 | |
| GB | 2225309 | A | 5/1990 | |
| GB | 2233627 | | 1/1991 | |
| GB | 2237788 | A | 5/1991 | |
| GB | 2238304 | A | 5/1991 | |
| GB | 5551431 | A | 7/1992 | |
| GB | 2 262 929 | A | 7/1993 | |
| GB | 2284587 | A | 6/1995 | |
| JP | 55-134961 | | 3/1954 | |
| JP | 52-136089 | | 11/1977 | |
| JP | 60-89154 | | 6/1985 | |
| JP | 61-93061 | | 5/1986 | |
| JP | 63-500934 | | 4/1988 | |
| JP | 4-62653 | | 5/1992 | |
| WO | PCT WO92/06013 | | 4/1992 | |
| WO | WO 93/02928 | | 2/1993 | |
| WO | WO 02/085713 | | 10/2002 | |
| WO | WO 03/047881 | | 6/2003 | |

OTHER PUBLICATIONS

*Reed Invests in PET Paint Cans*, Plastics & Rubber Weekly, Feb. 3, 1990, at 8 (Croydon; Surrey, England).

D. Pelous, *Avi Annonce la Couleur*, Emballages, Nov. 1990, at 17 (Die fran, cais d''editions; Paris).

*Thinking Out Of The Tin Creates Great Pains*, Packaging News, May 2003 at 12 (Maclean-Hunter; London).

Gail Underwood, *Printed Pails Compete For Attention*, Packaging News, Feb. 990, at 29 (Maclean-Hunter; London).

Robert Eller, *The Plastic Paint Container: Has Its Time Finally Come*?, Modern Paint and Coatings, Oct. 1983, at 177 (Palmerton Pub. Co.; Atlanta).

B. van bedaf, *Solid Paint Container Is World First*, Packaging News, May 1985, at 24 (Surry Hills, N.S.W.: Yaffa Pub. Group).

*Container Stands By its Design*, Packaging Week, Nov. 7, 1990, at 25 (Benn Publications Ltd.; Tonbridge, Kent).

*Bristling With New Ideas*, Packaging Week, Nov. 7, 1990, at 21 (Benn Publications Ltd.; Tonbridge, Kent).

*Developments in Paint Packaging*, European Polymers Paint Colour Journal, Mar. 20, 1991, at 153 (FMJ International Publications; Redhill, Surrey, England).

*Confident Approach At RPC*, Packaging Week, Jun. 19, 1991, at 16 (Benn Publications Ltd.; Tonbridge, Kent).

*Marktgerechtes Verpackungsdesign*, VR Verpackungs-Rundschau, Jun. 1991, at 688 (Heusenstamm, P. Keppler Verlag KG).

H. Thompson, *Infinite Uses Of Sleeving*, Packaging Week, Jun. 26, 1991, at 28 (Benn Publications Ltd.; Tonbridge, Kent).

David Greenfield, *Manufacturers Keeping Pace With Paint Container Market*, Modern Paint And Coatings, Feb. 1992, at 28 (Palmerton Pub. Co.; Atlanta).

Stafford Cliff, *Les Sensations*, The Best In Specialst Packaging Design, 1993, 4 pages (B.T. Batsford Ltd; London).
Jane Weatherley, *Breathing New Life Into Old Favourites*, Packaging Week, Oct. 13, 1994, at 20.
R. Leaversuch, *See-Through Plastic Cans Enliven Paint Packaging*, Plastics Technology, Aug. 2001, at 45 (Gardner Publications; Cincinnati, Ohio).
Anne and Henry Emblem, *Design Fundamentals: Packaging 2 Prototypes*, 2000, at 22-24, 46, 51, 59, 108 (Roto Viston SA; Switzerland).
Cathy Bond, *Paints Packed with Punch*, Marketing, May 18, 1995, at 25 (Haymarket Publishing LTD; London).
Abstract of the following article: R. Pidgeon, *Dulux Relaunches Paint in a User Friendly Can*, Packaging Week, Jan. 20, 1993, at 6.
Abstract of the following article: F. McWilliam, *Reed Moves Into PET With Paint Container*, Packaging Week, Jan. 3-10, 1990, at 1.
Abstract of the following article: Anon, *Crown Claims First for Paint Packaging*, Packaging Week, Sep. 27, 1989, at 11.
Abstract of the following article: Anon, *New Look Paint: New PET Paint Cans From Delux*, Packaging Innovation, Mar. 2003, at 1.
Abstract of the following article: M. Urry, *Crown: Cleaning Up in the UK Paint Market*, Financial Times, Jan. 4, 1990, at 8.
Abstract of the following article: Anon, *Closure and Spout*, Can. Packag., Dec. 1994, at 35.
Maggie Urry, *Packaging—Crown; Cleaning Up in the UK Paint Market*, Financial Times, Jan. 4, 1990, at 8 (The Financial Times Ltd., London).
David Greenfield, *Manufacturers Keeping Pace with Paint Container Market*, Modern Paint and Coatings, Feb. 1992, at 28 (Communications Channels Inc.).
W. Guise, *Polypropylene in Packaging*, Packaging, Apr. 1993, at 4 (Turret Group, UK).
Supplementary European Search Report dated Feb. 22, 2005.

* cited by examiner

FIG. 8
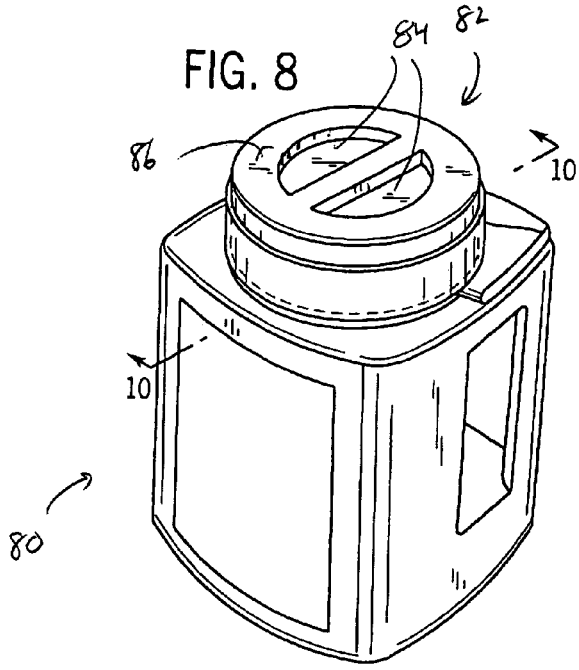
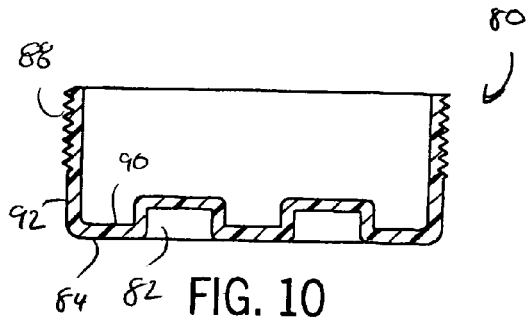
FIG. 10
FIG. 9
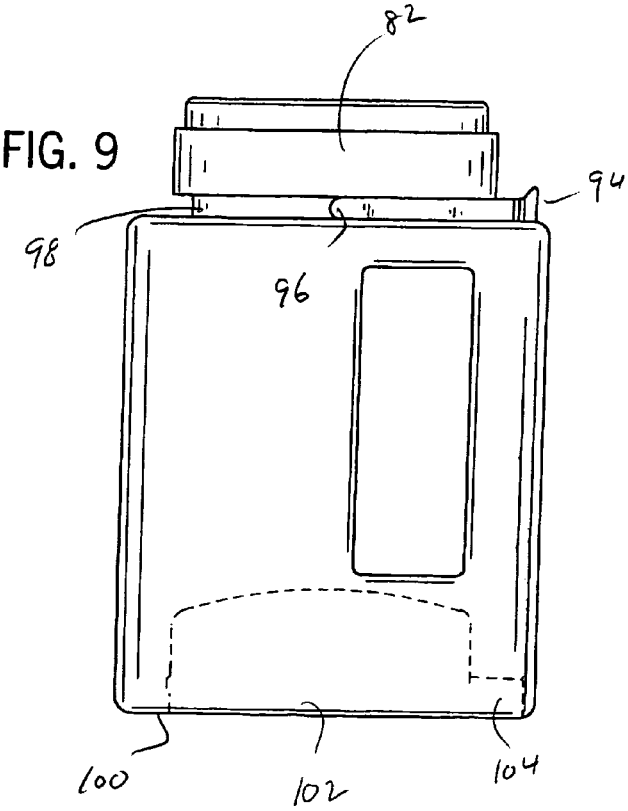

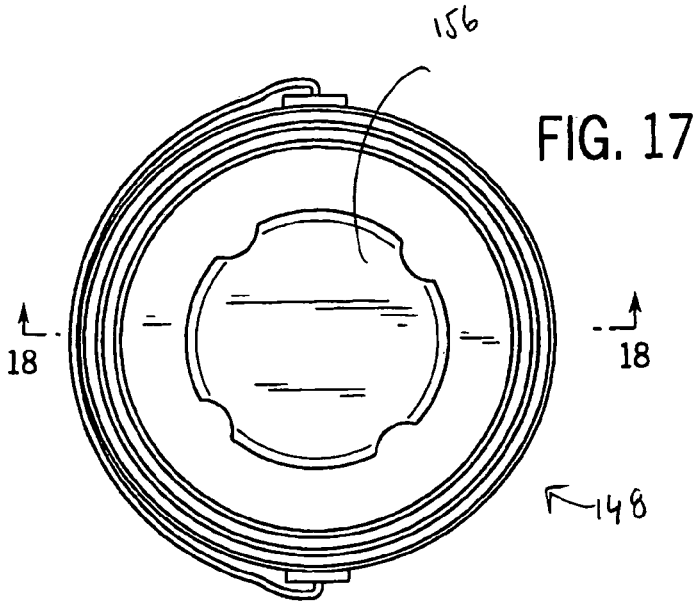
FIG. 17
FIG. 18
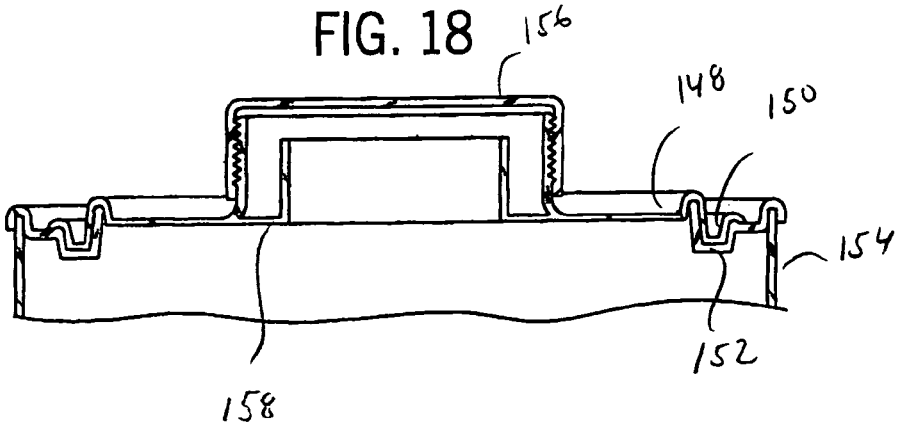

PAINT CONTAINER

CROSS-REFERENCE TO RELATED PATENT APPLICATIONS

None

BACKGROUND OF THE INVENTION

The present invention relates generally to the field of containers and more specifically a container for the distribution, sale, and use of paint.

Typically, paint for application to a house or building for both interior and exterior applications is sold in a cylindrical one gallon metal container. The metal container includes a round base and a cylindrical side wall attached to and extending from the base. The side wall terminates in an upper rim or chime having a u-shaped channel that frictionally receives and engages a plug or lid having a downwardly extending u-shaped annular ring that is frictionally engaged by the walls of the u-shaped channel.

The lid of a conventional paint container is removed by prying the annular ring out of the channel. This is accomplished by using a lever between an outer upper edge of the cylinder and the outer edge of the lid. In order to ensure that the lid does not fall off of the container, the interference/friction fit between the annular ring of the lid and the u-shaped channel of the container is sufficient to require the use of tools to remove the lid. Accordingly, a lever such as a screwdriver is used to pry the lid off of the upper rim by using the edge of the side wall as a fulcrum to apply sufficient force to the outer edge of the lid to remove the annular ring form the u-shaped channel. Depending on the amount of friction that must be overcome, a user usually has to apply pressure at a number of points about the circumference of the lid and container. The repeated insertion of the lever may result in damage to the lid or the coating on the inner surface of the metal lid that is intended to prevent rust or contamination of the paint.

The paint may be poured from the container into a tray or other smaller container to be used by the painter to apply the paint to the intended surface either by brush, pad, roller or other mechanical or electrical system. Almost anytime paint is poured, paint drips down the outside of the cylindrical wall and covers any identifying label. If the drips are significant, the paint may streak down the outer edge of the cylindrical wall and drip to the supporting surface that the paint container has been placed on. In any event, a certain amount of paint will be trapped within the unshaped annular ring of the upper edge of the cylindrical side wall.

When the lid is placed back onto the top of the container, the downwardly extending unshaped ring on the lid will be soiled by the paint in the annular receiving area of the cylindrical wall. This creates a potential problem the next time the lid is removed and placed on a supporting surface. The paint on the annular surface may soil the surface upon which the paint lid rests or the hands of the user when they replace the lid again after use. If latex paint is in the container then the latex may dry in the channel and act as an adhesive between the lid and container making subsequent removal of the lid more difficult. The dried paint in the channel may prevent an air tight seal as result of paint buildup preventing the lid from being fully seated within the channel. Further, paint trapped in the channel may be splattered about the room when the lid is replaced and the trapped paint will likely spill over the edge and streak down the side of the container.

Additionally, if the can its If is used as the container from which a brush is dipped by the painter, a significant amount of paint will accumulate in the channel as the brush is removed and excess paint is wiped against the edge of the can. Further, the inner annular edge of the container channel makes it difficult to uniformly wipe paint off of the brush. This results in an uneven application of paint on the brush and on the surface to be painted.

Further the cylindrical container provides other disadvantages in the shipping, display and handling of the container by the end user. First, since the containers are round, the area between the cans represents wasted space when the container are shipped from the factory to the retail outlet. This wasted space must be paid for in terms of shipping costs. Similarly, shelf space at the retail outlet is wasted by the area between the cans. Further, the typical can does not include a stackable feature that securely allows the cans to be stacked to any significant height. Since the cans are cylindrical, the label must also be cylindrical and therefore does not present the ideal display surface for the consumer at the retail outlet. As the consumer typically walks down the isle, the customer views the container at an angle which reveals only a portion of the label. Many display shelves also permit more than one can to be stacked in a front to back fashion. The cylindrical shape also limits the number of rows of cans that may be stacked on a display shelf.

The handle of the typical paint container is a thin curved wire member comprised of a 105 gauge material that digs into the user's hand under the weight of the paint and the container. It is difficult to carry more than one paint container in each hand utilizing the curved wire. Additionally, the curved wire handle requires handle pivot or "ear" supports to be added to the outer surface of the cylindrical can. These pivot supports add assembly and material costs to the container. The pivot supports further affects how the containers must be packed for shipping and for display. Since the pivot supports extend outward from the container, additional space between products or placement such that the pivot supports are in the "dead" space zone between the containers is required.

The cylindrical paint can does not provide a surface to support a paint brush. In order to balance a paint brush on the open container, the brush must be supported by two points on the outer lip. This is most easily accomplished with the bristles balanced at one point and the ferrule or handle balanced at another point. As discussed above, paint often collects in the channel of the container resulting in the ferrule or handle being soiled. Alternatively, if the channel does not contain paint, the placement of the bristles on the edge of the container will likely result in paint dripping into the channel and/or on to the edge of the container, which will likely soil the ferrule or handle if the ferrule or handle is subsequently placed on the soiled region.

Paint that falls into the channel also presents a problem when the lid is being secured to the container after use. The paint in the channel is forced out of the channel as the annular ring of the lid is being located into the channel. Unless the lid is covered, the paint in the channel will splatter about the room as the lid is securely attached to the container. This result is due to the fact that the lid must be fully seated within the channel and a significant force is required. Typically a rubber mallet is used and the lid is struck a number of times with significant force.

Another problem with the existing paint container is that if the paint is shaken in the container with the lid securely attached, the underside of the lid will become covered with paint and becomes difficult to handle when it is removed from the container.

From the foregoing, it would be desirable to provide a paint container that would minimize shipping costs and permit a maximum number of containers to be stacked on a retail outlet shelf per linear foot of display. It would be further desirable to provide a product and method for displaying a paint product that allows for non-curved labeling. It would be desirable to provide a container that must be positioned correctly on the shelf, and is not easily rotated to a position that makes it difficult for a consumer to see the label. It would also be desirable to provide a container system that facilitates stacking the cans one on top of one another. Another feature that would be desirable is a container system that facilitates stacking the containers one in front of the other.

It would also be desirable to provide a container having a non drip pouring mechanism in order to maintain a clean work area. It would also be desirable to provide a paint container that eliminates the need for handle supports or ears on the cylinder. It would also be desirable to provide a handle that is easy for the user to use and does not cut into the user's hand. Additionally, it would be desirable to provide a container with a lid that also serves as a paint container. It would still further be desirable to provide a lid that may be attached securely onto the container without the need for tools. It would also be desirable to provide a container with a spout that provides for a brush to be inserted into the container and includes a non-curved edge to provide for even wiping of the brush. It would also be desirable to provide a container that does not dent when dropped or hit. It would also be desirable to provide a visual confirmation that the lid is securely attached to the container. It would yet further be desirable to provide a container that is not affected by the drying of latex paint between the lid and container. It would also be desirable to provide the foregoing features in a standard lid having an annular ring that is frictionally secured within a u-shaped channel of the container. It would be desirable to provide a paint container with the foregoing features alone or in any combination.

SUMMARY OF THE INVENTION

An exemplary embodiment relates to a paint container. The paint container includes a body having a bottom, a plurality of side walls, and a top. An attachment mechanism is located proximate the top. A cap is configured to be secured to the attachment mechanism. The container further includes a spout extending from the top and substantially surrounded by the attachment mechanism. The spout permits paint to be poured from the paint container. Paint spilled between the spout and the attachment mechanism flows back into the paint container via a channel. A further embodiment provides a spout sized to permit entry of at least a standard two inch brush into the container.

Another exemplary embodiment relates to a stackable paint container. The stackable paint container includes a body having a body, a plurality of side walls, and a top. A spout extends from the top, and the bottom includes a recess configured to receive the top of a second paint container. A further exemplary embodiment relates to a stackable container wherein the recess in the bottom of a first container includes an open back to permit the first container to be slid forward off of a bottom container without first lifting the first or top container upwardly.

A still further embodiment relates to a paint container having a body with a bottom, a plurality of side walls, and a top including a flat region. A spout extends from the flat region and is substantially surrounded by an attachment mechanism. The plurality of sides are attached to one another to form a circumference that is non-circular.

Yet another embodiment relates to a paint container including a body having a bottom, a plurality of side walls, and a top. A spout extends from the top and a first handle is located proximate the side walls. A second handle extends over the top and is attached to the container along a line perpendicular to the plane defined by the first handle and the spout.

A still further embodiment relates to a paint container, comprising a body having a bottom, a plurality of side walls, and a top. A spout is located proximate the top, and a holder is formed in the top configured to support a paint brush.

Alternative exemplary embodiments relate to other features and combinations of features as may be generally recited in the claims.

BRIEF DESCRIPTION OF THE DRAWINGS

FIG. 8 is perspective view of an other paint container embodiment.

FIG. 9 is a side elevation view of the paint container embodiment of FIG. 8.

FIG. 10 is a cross-sectional view of the cap of the paint container of FIG. 8 in an inverted position.

FIG. 17 is a perspective view of the top region of the paint container of FIG. 1 with a standard paint container.

FIG. 18 is a detailed cross-section taken generally along line 18—18 of FIG. 17.

DETAILED DESCRIPTION OF THE PREFERRED EMBODIMENTS

Figure 1:
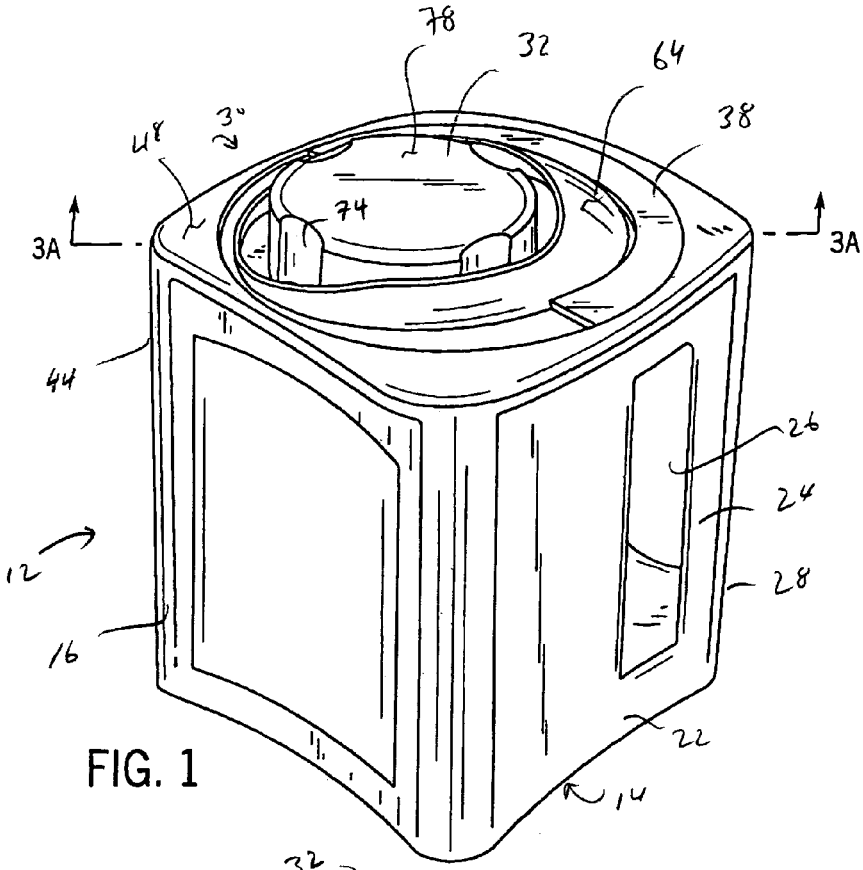
FIG. 1 is a perspective view of a paint container.
Figure 2:
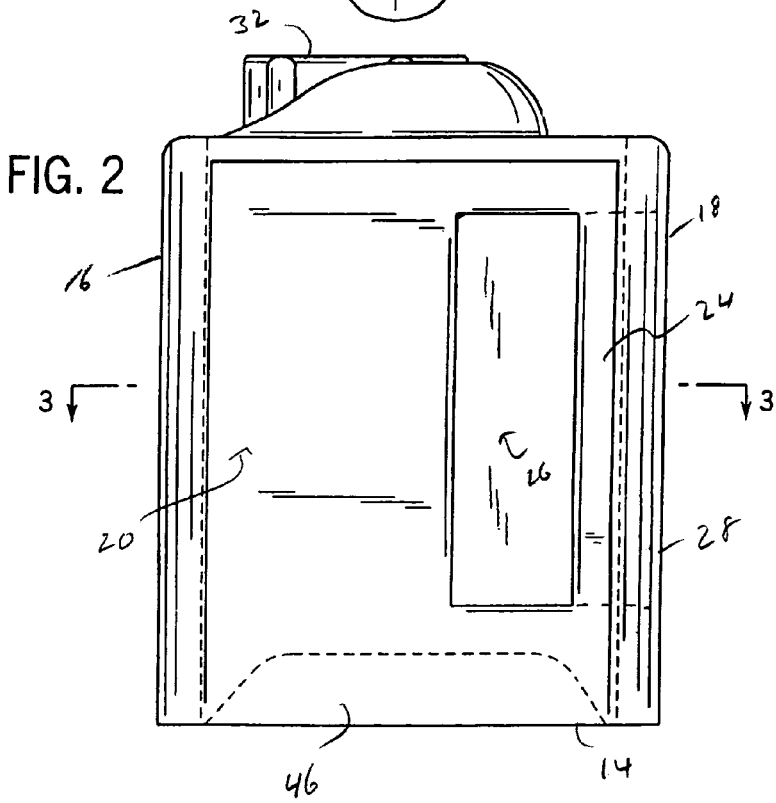
FIG. 2 is a side elevation view of the paint container of FIG. 1.

Referring to FIGS. 1–6, a paint container 10 includes a body member 12 having a bottom 14, a front wall 16, a back wall 18 and a pair of opposing side walls 20, 22. Body member 12 further includes a handle 24 formed by an aperture 26 located proximate to a first corner 28. Paint container 10 further includes a top region 30 integrally formed with the body member 12. In one embodiment paint container 10 is formed from a plastic material that is injection molded, blow molded, or injection blow molded. However, the paint container may formed from other methods known in the art. Alternatively top region 30 may be attached to the body member 12 with either a mechanical connection, interference fit or chemical bond.

A cap or cover 32 is threadably secured to an attachment or land 34 of the top region 30. As show in FIG. 5 top region 30 includes a spout 36 from which the paint stored within the container 10 is poured. The spout 36 is covered by cap 32 when the cap 32 is threadably secured to the container. A second handle 38 is pivotally attached to land region 34. Although the handle 38 is shown in a broken fragmented view, the second handle is pivotally attached to front corner 40 formed by the intersection of front wall 16 and side wall 22, and the rear corner 42 formed by the intersection of rear wall 18 and side wall 20. The orientation of the handle 38 is shown in dashed lines in FIG. 6. In this manner the first handle 24 and second handle 38 work together to allow a user to pour the paint out of spout 36 over the corner 44 formed by the intersection of front wall 16 and side wall 20. The first and second handles cooperate to provide a stable pouring support for a user. To pour the paint from the container the user lifts up the second handle in the direction illustrated in FIG. 3A until the second handle lies in a plane substantially perpendicular to the plane defined by the first handle 24 and spout 56. The paint is poured from the container by pivoting the container about the handle pivot points. In this manner the first handle 24 is rotated about the pivot points in the plane defined by first handles and spout. In this manner both hands are used to pour the container and distributing the weight accordingly as needed to control the amount and speed of the paint being poured.

Turning now to the body member 12, the bottom 14 is formed integrally with the front, rear and side walls as a one piece unit. Alternatively, the bottom 14 may be mechanically attached or chemically bonded to the walls. Referring to FIG. 1 the bottom 14 is substantially square to provide a base upon which a rectangular container may be formed. The substantially rectangular feature of the container 110 reduces the dead space between multiple containers 10 when they are shipped, as compared to the traditional cylindrical paint container. This in turn reduces shipping costs and maximizes shelf space at the point of purchase by a consumer.

Figure 4:
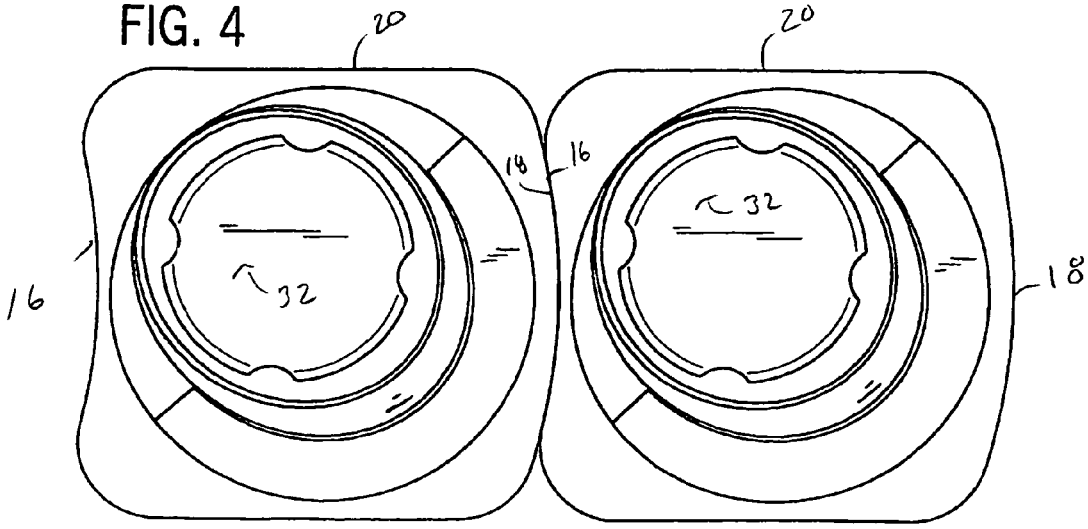
FIG. 4 is a top view of two nested paint containers.

As illustrated in FIG. 4, the front wall 16 of container 10 is concave and cooperatively engages with the convex shape of rear wall 18 of another container. In this manner, the containers 10 may be nested in a front to rear configuration. This nesting provides for a more secure packing arrangement for shipping and also provides for a tight display on a retail shelf. However, other nested configurations may also be used. For example, the rear wall 18 could be concave and the front wall 16 could be convex. Further, other cooperatively nesting configurations could be used, such as having the convex/concave arrangement of the front and rear walls 16, 18 over a certain portion of the walls 16, 18 or in a different configuration such as concave/convex in a top to bottom arrangement as opposed to the side to side arrangement illustrated.

Container 10 further includes a recessed region 46 in bottom 14. The recessed region 46 is configured to permit the containers to be stacked vertically in a nested fashion. The depth of recessed region 46 may be a predetermined distance to allow the cap 32 to be fully seated within the recess 46. In this manner bottom 14 would rest upon the surface 48 of the top region.

Recess 46 may be tapered and have a generally round or square orientation. In order to facilitate removing of the container 10 from a lower stacked container 10, recess 46 may have an open region proximate rear wall 18. This would allow a consumer to simply pull a top container 10 forward to remove it from the lower container 10. Since a filled paint container can weigh eight pounds or more, the open rear region of the recess 46 would make it easier for the consumer to separate the containers while still having the benefit of the nesting feature. Alternatively, the rear portion of the recess could have a partially open area that would require a top container to be lifted only a small amount to disengage it from a lower container.

Figure 3:
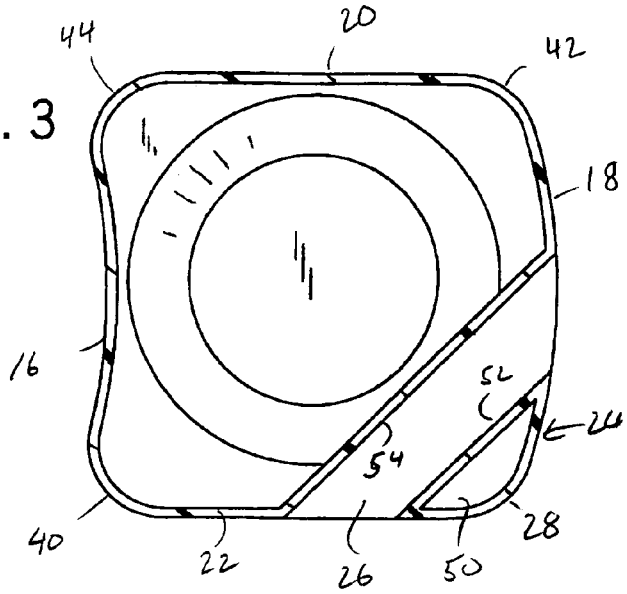
FIG. 3 is a cross-sectional view of the paint container taken generally along lines 3—3 of FIG. 2.

Referring to FIG. 3, first handle 24 includes a hollow region 50 which will include paint when the container 10 is filled. While aperture 26 is shown as a smooth continuous opening it is possible to provide finger grips or other irregularities on wall 52 of aperture 26 to facilitate handling by a consumer. Further the walls 52, 54 that define the aperture 26 may have a curved configuration to further facilitate the handling of the container by a user. For example wall 52 could have a convex shape extending into the aperture 26, while wall 54 could have a concave shape extending into the main area of the container 10.

Figure 5:
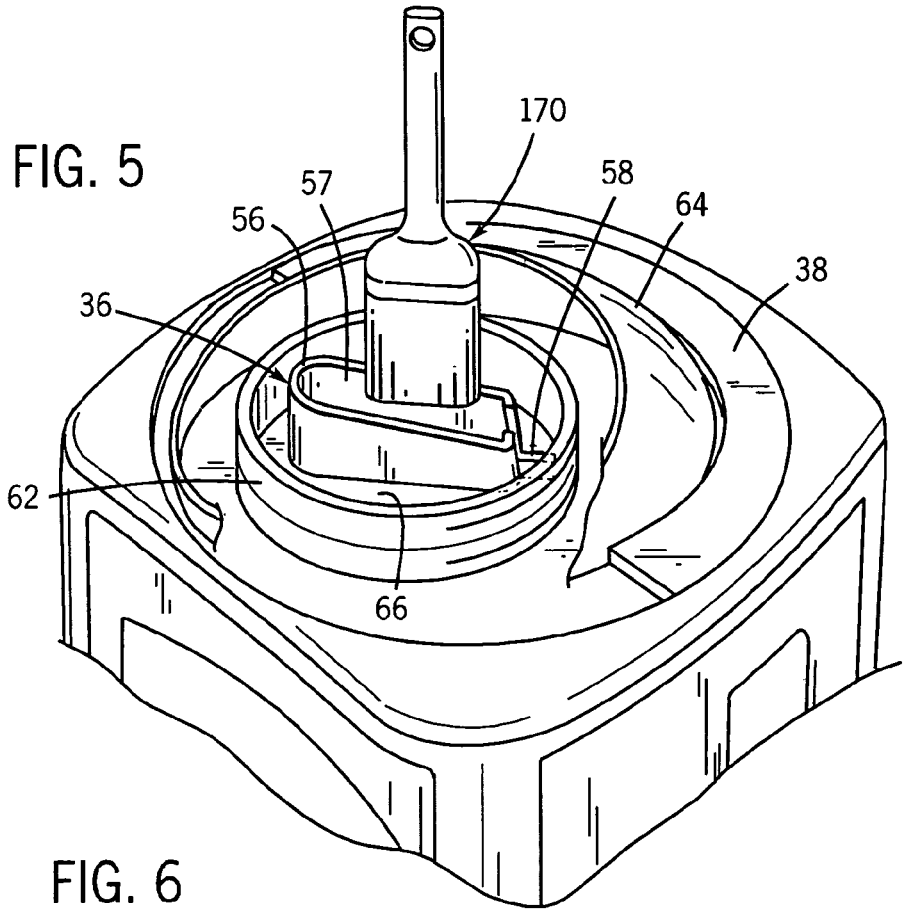
FIG. 5 is a perspective view of the spout of the paint container of FIG. 1.

Referring to FIG. 5, spout 36 will be discussed further. Spout 36 is situated such that the top portion 56 of spout 36 points toward corner 44 of the container. The spout 36 and handles 24 and 38 cooperate to allow the paint to be poured out of spout 36 in a general direction over corner 44 of the container. Spout 36 includes an open channel 58 that permits paint that drips over the spout to return to the container. In this way paint that drips over the spout 36 is reclaimed. This solves the problem of paint dripping over the container 10 and soiling the container 10 and streaking down the sides of the container 10 and further soiling the support surface that the container is placed on. As illustrated in FIG. 5 a first channel 60 is formed between spout 36 and the raised portion 62 of the container. The channel 60 is angled such that any paint that drips over the top portion 56 of spout 36 flows along channel 60 into the opening 58 and thereby reclaimed within the container. Alternatively, channel 60 may include a hole or recess opening toward the rear portion of the spout, or the point closest to handle 24.

Spout 36 includes an elongated opening 57 through which a brush 170 may be inserted to paint directly from the container. Opening 57 may be configured to permit up to a standard one inch brush, or up to a standard two inch, or even up to a standard four inch brush or greater to be inserted into the container directly through the spout 36. Alternatively, a separate opening may be included in the top portion of the container. One such embodiment is illustrated in FIG. 6.

Container 10 further includes a splash guard 64 that partially surrounds cap 32. Guard 64 ensures that no paint will splash outward toward the consumer while the container 10 is being handled. Further, guard 64 further protects second handle 38 from being soiled in the region that will be handled by the user.

Figure 6:
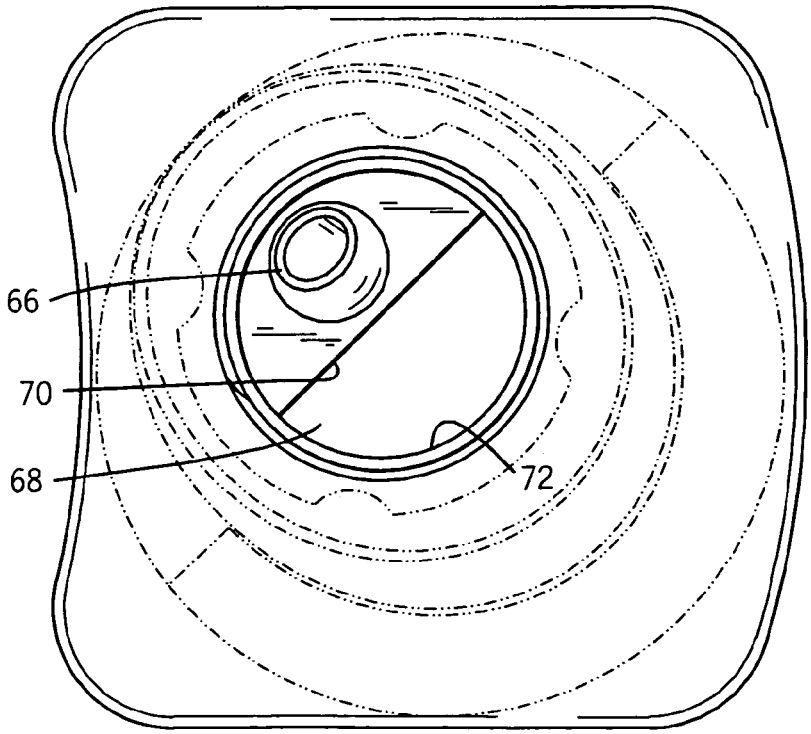
FIG. 6 is a top view of a further embodiment of a paint container with the cap removed.

Another embodiment of a spout 66 is illustrated in FIG. 6. While the spout 66 has a similar configuration to spout 36 discussed above, the base portion includes an opening 68 sufficient to allow a painter to dip a brush directly into the container. A straight edge 70 is located between the opening 68 and the spout 66. Straight edge 70 allows the painter to wipe excess paint off of the brush prior applying the paint to the surface to be painted. The straight edge 70 is an improvement over the traditional cylindrical container which provides only a rounded edge upon which to wipe excess paint off the brush. The distribution of paint on the brush will vary depending upon the surface that the brush is wiped onto. For example, if a round edge is used, more paint will remain deposited on the central portion the brush then on outer edges of the brush. The opening 68 illustrated in FIG. 6 provides for both a straight edge as well as a curved surface 72 upon which a brush could be wiped to remove excess paint. Further, one side or portion of the edge 70 may include a comb or plurality of teeth that are used in the art to comb out excess paint from within the brush and between the bristles. This combined surfaces would reduce the number of tools that a painter would need to carry and keep clean. The opening is configured to permit at least a two inch brush to be dipped directly into the paint in the container and preferably a three inch brush. However, depending on the size of the opening a larger brush may be accommodated. This feature allows the paint to be both poured into a separate dish for painting (or cap) or allows the paint to be accessed directly through the opening. Other configurations, allow for a spout to have an opening configured to allow for a two to three inch brush to be dipped into the can directly through the spout.

Figure 3A:
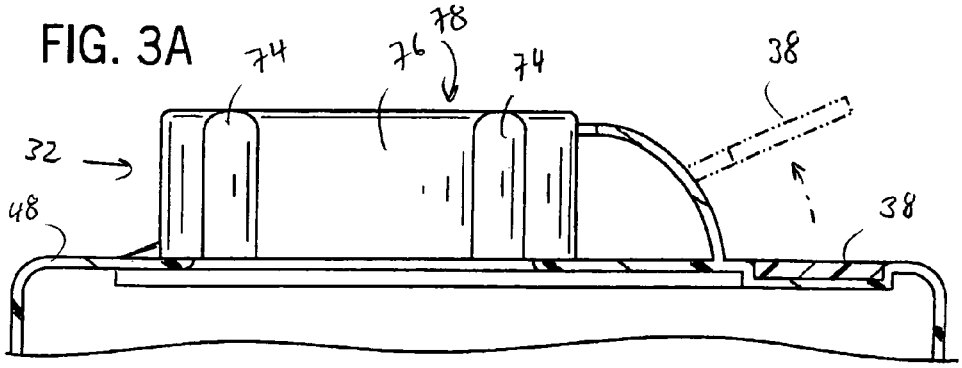
FIG. 3A is a cross-sectional view of the paint container taken generally along lines 3A—3A of FIG. 1.

Referring to FIG. 3A, Cap 32 can be used both as a cover to the container 10 as well as a paint dish. Cap 32 includes a plurality of indents 74 located on the side wall 76 of the cap to facilitate rotation of the cap by a user to remove or secure the cap to the container 10. The cap 32 includes internal threads that are attached to an external threads of raised portion 62. Alternatively, cap 32 could include external threads that would threadably engage internal threads on raised portion 62. Depending on whether the threads are external or internal the geometry of the cap and supporting raised portion can be configured to ensure that the threads remain free from paint. Alternatively a self cleaning thread design could be used to minimize the amount of paint that adheres to the threads. The cap 32 includes a top portion 78 upon which the cap rests when inverted and placed on a supporting surface. When the cap 32 is replaced onto the container 10 after it has been used as a paint dish, paint may drip from the dish into the spout region. The same reclamation feature that permits paint that drips over the spout 36 to be reclaimed in the container, would also work on any paint that drips from the inner surface of the cap 32 onto the spout 36 or surrounding channel.

Turning now to FIG. 8, another embodiment of a container 80 includes a cap 82 having two recesses 84 extending downwardly or inwardly from an outer upper surface 86. Cap 82 includes outer threads 88 (FIG. 10) that threadably engage a threaded portion of the container 80. As noted above, the external threads 88 allow the cap 82 to be used as a paint dish in the inverted position as shown in FIG. 10. If the cap 82 had another inner wall (not shown) extending upward from bottom surface 90 inward of outer wall 92, then internal threads could be used on outer wall 92 without soiling the threads when paint is added to the cap 82.

The body portion of container 80 is similar to the body portion and handle described above with respect to container 10. Another feature of container 80 is a second handle 94 that pivots about a pivot 96 (FIG. 9). Pivot 96 may be attached to a collar 98 that slidably rotates about the cap to allow the second handle to be raised in any direction about the cap. This feature will allow the user to conveniently carry the container in any orientation about a vertical axis extending perpendicular to a bottom 100 of the container 80 and the cap 82. This may be helpful given that the general shape of the base and sides of the container 80 is square or rectangular.

FIG. 9 illustrates the recessed region 102 that facilitates the stacking of containers 80 one on top of another. Recess 102 also includes a recess portion 104 for second handle 94. As discussed above with respect to container 10, recess 102 may have an open back end so that the top container 80 may be slid directly forward off of a bottom container 80.

Figure 11:
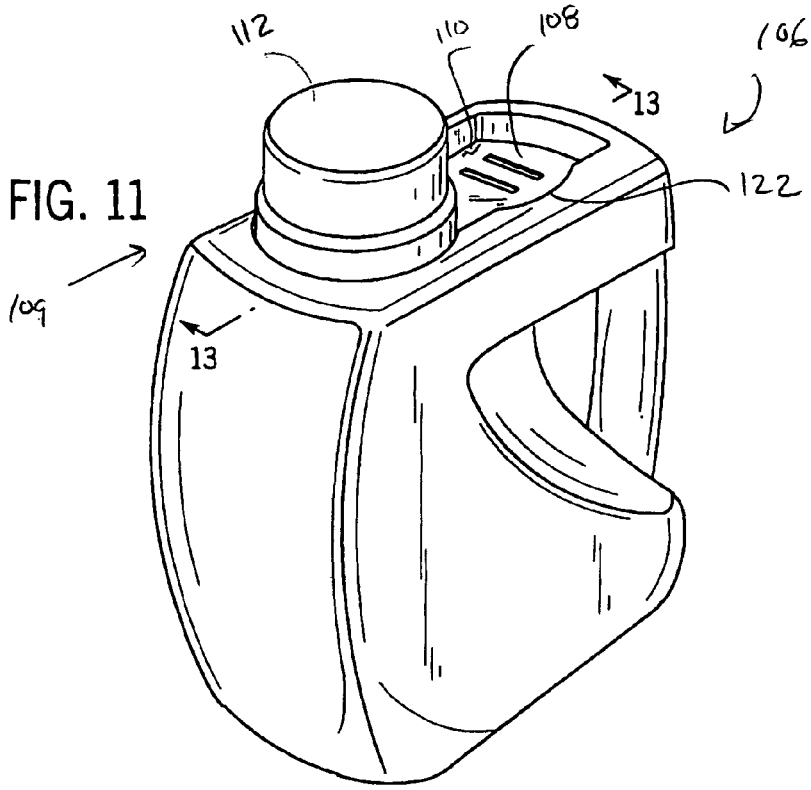
FIG. 11 is a perspective view of another embodiment of a paint container.
Figure 12:
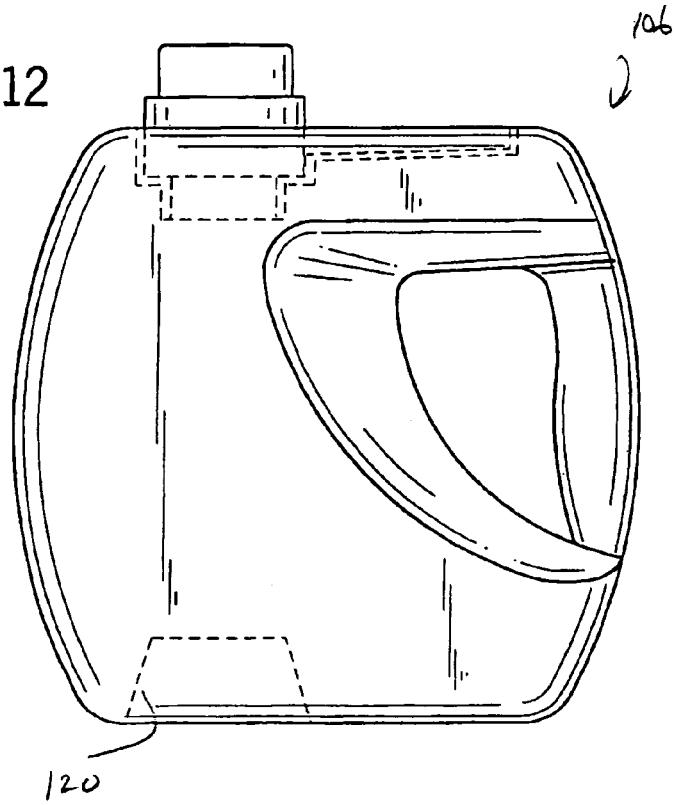
FIG. 12 is a side elevation view of the paint container of FIG. 11.
Figure 13:
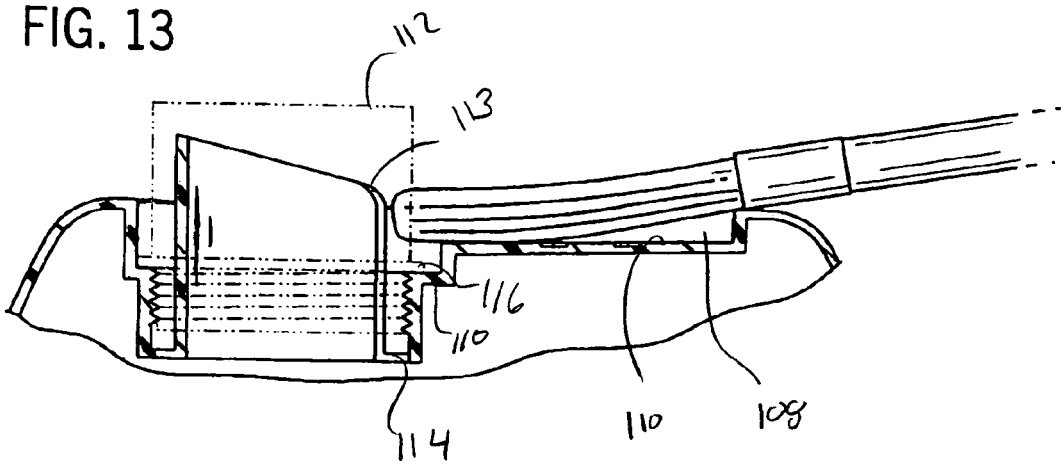
FIG. 13 is detailed cross-sectional view taken generally along line 13—13 of FIG. 11 with the cap shown in phantom.

Turning now to FIGS. 11–13, another embodiment of a container 106 includes an integral paint brush holder 108 located within the top 109 of the container. As discussed above, one problem with the traditional cylindrical paint can is that there is no convenient place to support a paint brush. While a paint brush may be balanced on the rim of the traditional paint container, it often results in the ferrule or handle being soiled by paint that is trapped in the channel of the traditional container. The bottom 110 of the paint brush holder 108 is angled such that any paint that drips from the brush will flow toward the open area of the container 106 and will be reclaimed within the container 106. Although not shown, the paint brush holder 108 may used in conjunction with the spouts described above.

As illustrated in FIG. 13, a cap 112 is threadably attached to the container 106 with an opening 114 proximate the base of the spout 113. The brush holder 108 is directly in contact with opening 114. Cap 112 includes a shoulder 116 that engages the bottom surface 110 of the brush support proximate opening 114. In an alternative embodiment, the outer surface 118 of cap 112 may abut the bottom surface 110 proximate the opening 114 to prohibit any paint from entering into the container 106 when the cap is closed. In an alternative embodiment the brush holder 108 may also be used as a paint well for a small amount of paint. This is accomplished if the brush holder includes an opening only a certain distance from the base of the holder. In this configuration a certain amount of paint would be trapped within the holder until the container was tipped so that the paint would run over the wall portion and escape through the access opening into the container.

Paint brush support 108 may also include a recess or pair of recesses 122 so support the cap 112 in either an inverted or upright position when the cap 112 is not in the closed position. If the cap 112 is located within recesses 122 in the upright position any paint in the cap 112 may drip down into the brush support and be reclaimed in the opening 114. It is likely that paint will be in cap 112 if the container has been shaken to mix the paint or if the container had been stored on its side or simply tipped over. The recess holder on top of the container 106 may be used in conjunction with a paint brush support or may be included without the paint brush support. The container 106 may include a recess 120 as illustrated in FIG. 12 to enable two containers 106 to be stacked one on top of another.

Figure 14:
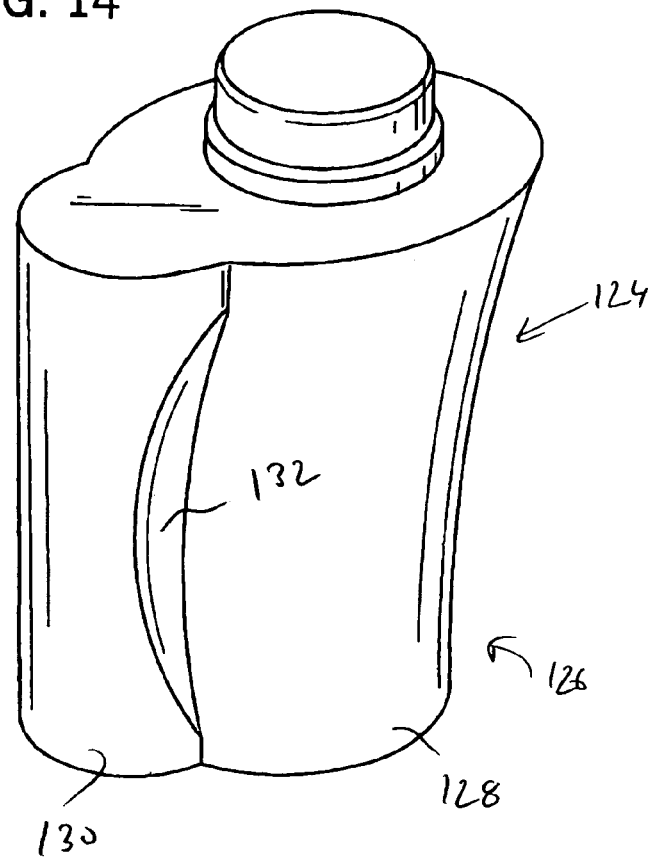
FIG. 14 is a perspective view of another embodiment of a paint container.

A further embodiment of a paint container 124 is illustrated in FIG. 14. This container may include the spout and reclamation features discussed above in connection with the other embodiments. The container 124 includes a body portion 126 having a first main region 128 and a second region 130 having indents 132 that allow a user to grip the container. The first and second regions are integrally formed as a one piece container and form a single storage area within the container for paint.

Figure 15:
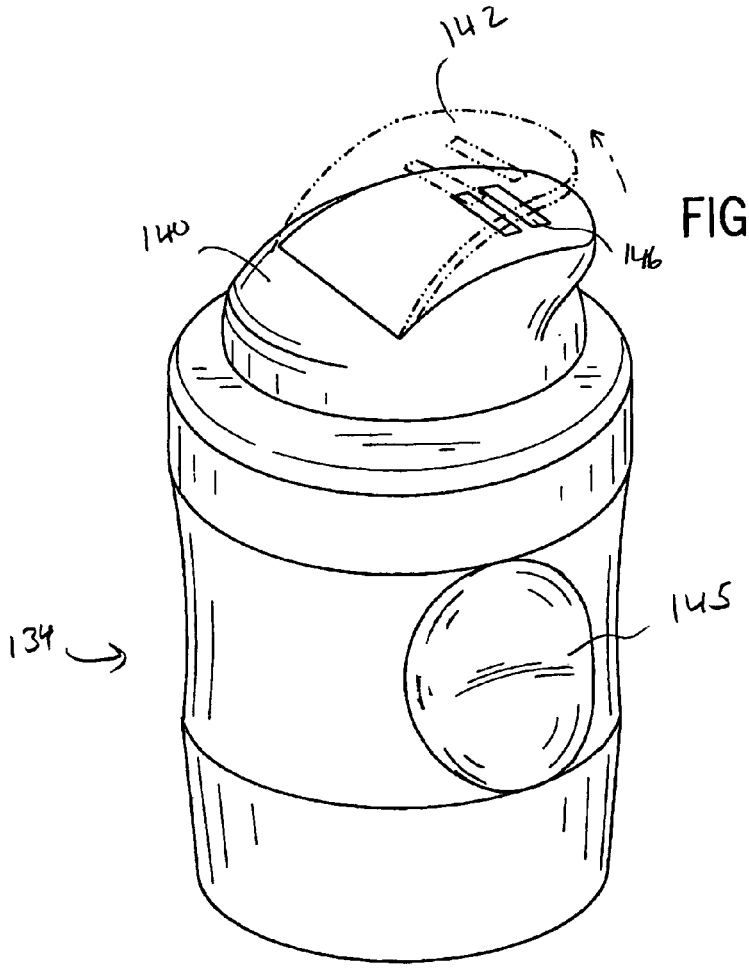
FIG. 15 is a perspective view of a further embodiment of a paint container.
Figure 16:
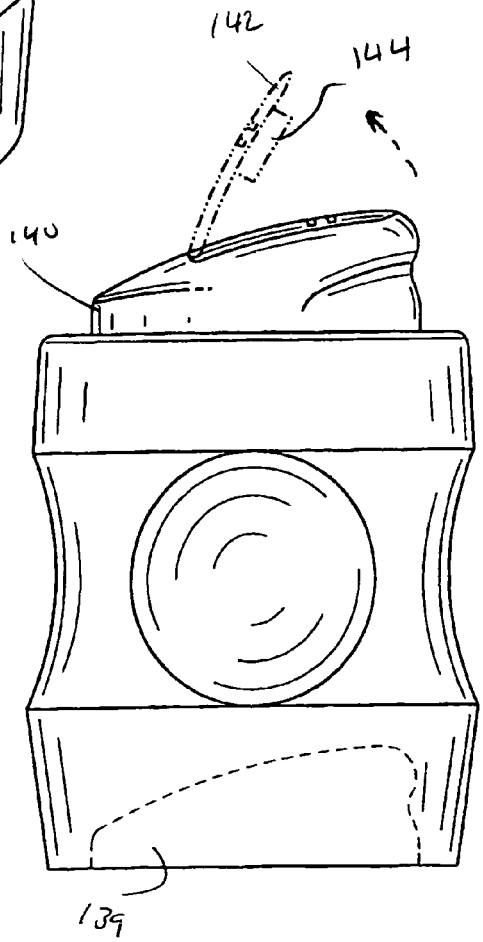
FIG. 16 is a detailed side elevation view of the cap area of the paint container of FIG. 15.

Another embodiment of a paint container 134 is illustrated in FIGS. 15 and 16. Container 134 includes a single region 136 having recesses 138 formed directly on single region 136. A cap 140 includes a pivoted cover 142 that is pivotally attached to the top of the container 134 to provide for pouring the paint without the need to unscrew the cap 140 completely. The pivoted cover 142 may include a downwardly extending member 144 that would positively engage an opening 146 in the cap 140. A pair of indents 145 are located on the sides of the container to facilitate handling by a user. The bottom of the container 134 includes a recess 139 to allow the containers to be stacked one on top of another.

Figure 7:
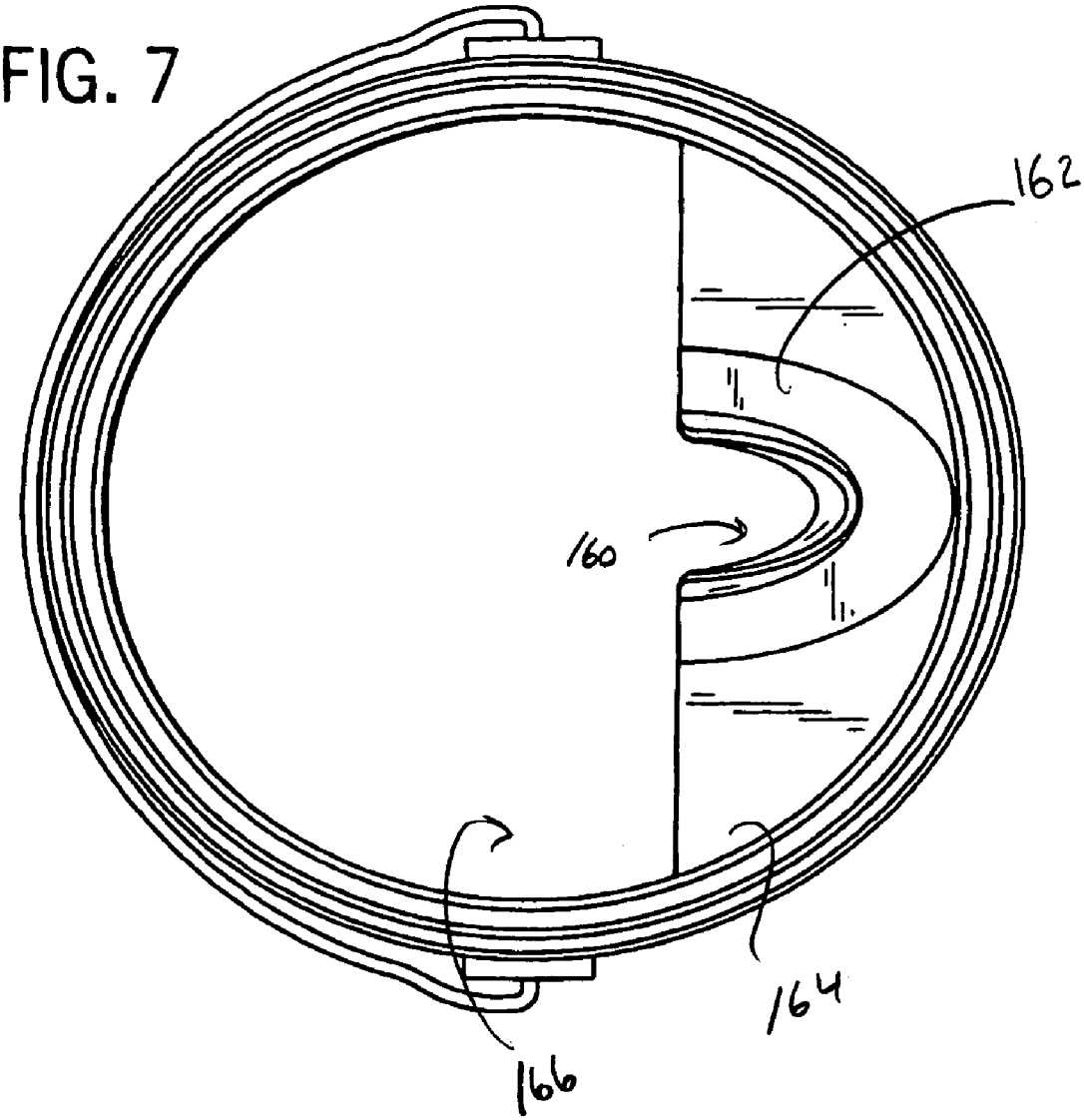
FIG. 7 is top view of another embodiment of a paint container.

The features discussed above such as the use of a cap, pivoted cover, pour spout, reclamation of dripped paint, and paint brush support could all be incorporated on to a traditional paint can lid or plug 148 as illustrated in FIGS. 7, 17 and 18. Referring to FIG. 7, a non-spill spout 160 with a reclamation channel 162 is secured to base plate 164 that defines an open area 166 to dip a brush directly into the paint can. Other features such as a cap may also be included. Referring to FIGS. 17 and 18 the features could be molded as a single unit with an annular ring 150 that frictionally fits within a traditional u-shaped channel 152 of a traditional paint container 154. Alternatively, a top member having one or more of the features discussed above could be attached to a separate circular member having an annular ring member 150. In this manner a cap 156 may be employed with a spout 158 providing the benefits discussed above in connection with the proposed embodiments for use with a traditional traditional cylindrical paint can.

Figure 19:
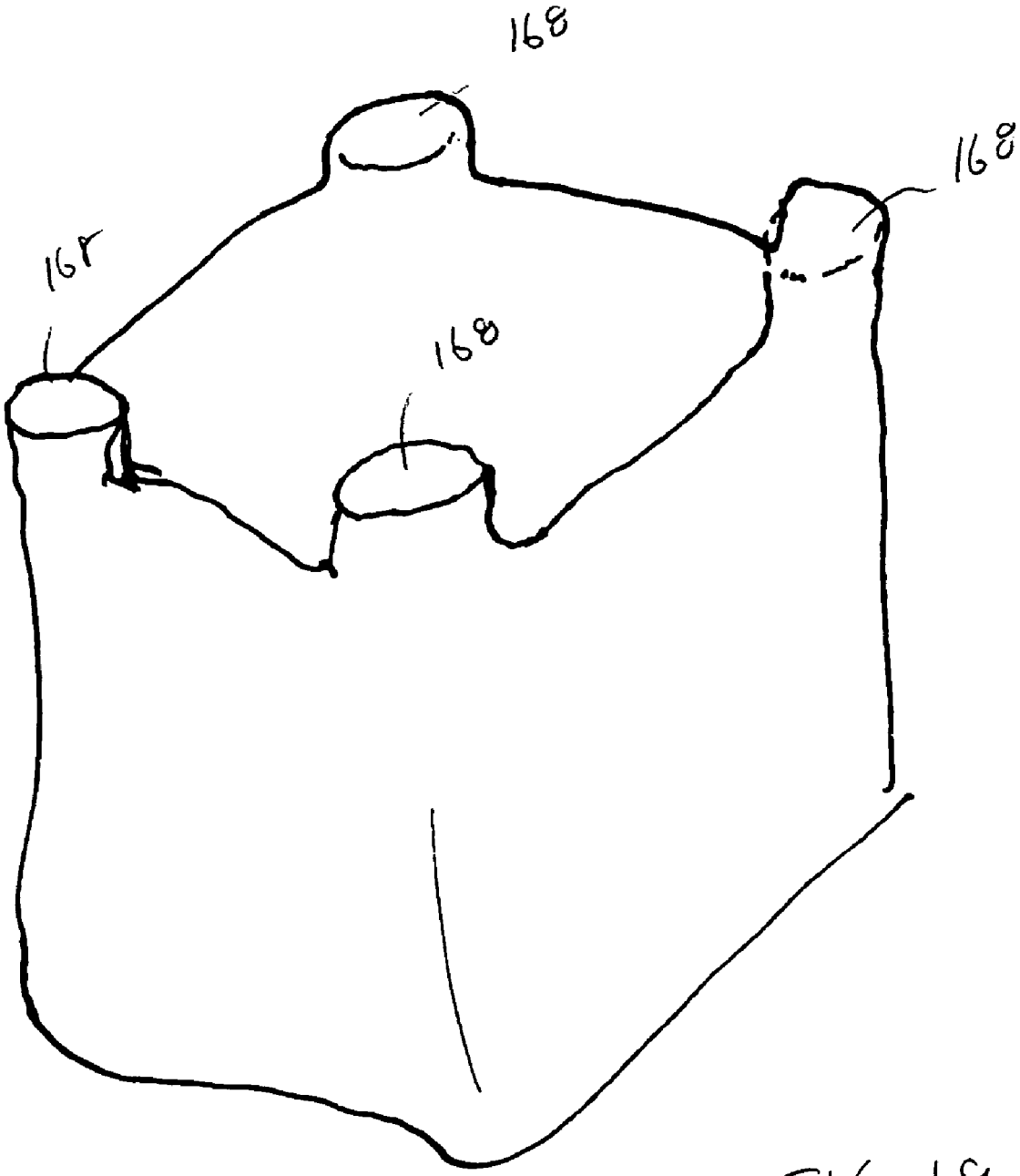
FIG. 19 is a schematic view of a container with raised portions.

As illustrated in FIG. 19, a container may include raised portions 168 to permit the containers to be fit within a shaker or machine to shake or mix the paint. The raised portions would be configured to avoid any interference with the top portion of the containers described herein and the standard shaking machines used to shake traditional paint cans.

The containers described herein may include rounded or curved transitions within the container, so that paint is easier to remove with a brush. This increases the ability to recycle the plastic container since the paint will not be captured in the connection between the base and the side walls of the container as in a traditional paint can. All of the designs and features discussed herein may be provided on containers of various sizes including a container configured to hold approximately a single gallon of paint or other fluid. Further as used herein the terms "two inch", "three inch" or "four inch" brush refers to the width of the brush.

Further modifications may be made in the design, arrangement and combination of the elements without departing from the scope of the invention as expressed in the appended claims For example a top member including one or more of the features discussed above such as the spout, reclamation structure, paint brush support, cap support, and others may be integrally formed with the body member or may be fastened to the container as a separate component. Additionally, the container may include transparent areas to allow the user to see the contents of the container. Further the cap attachment may include a transparent area to indicate whether the cap is securely attached to the container to prevent paint from accidentally being spilled. Although the container has been referred to as a paint container other liquids are also contemplated as being used within the container. While some of the features have a unique application to the storage and application of paint, other features may be used for other liquids as well. Additionally, the label that is applied to the container may include a blank white portion to permit the user or manufacturer to dab or paint a sample of the paint in the container to clearly show what color is contained within the container and how it will appear when painted on a white background. These and other modifications may be made in the design, arrangement and combination of the elements without departing from the scope of the invention as expressed in the appended claims.

What is claimed is:

1. A paint container, comprising:

a body having a bottom, a plurality of side walls forming a circumference that is noncircular, and a top, the top including a flat region;

a spout extending from the flat region and substantially surrounded by a raised neck portion;

a splash guard disposed proximate the spout and not extending beyond an outer periphery of the body, the splash guard being independent of the spout and being external to the raised neck portion;

an integral handle formed within the body; and a second pivotal handle having a center portion removably received within a depression on the top proximate the integral handle and located between an outer periphery of the body and the raised neck portion and being spaced from and nonadjacent to both the outer periphery of the body and the raised neck portion.

2. The paint container of claim 1, further comprising an open channel formed through the top permitting spilled paint to flow into the paint container.

3. The paint container of claim 1, wherein the body is constructed of plastic.

4. The paint container of claim 1, wherein the integral handle is formed into one or more of the plurality of side walls.

5. The paint container of claim 1, wherein the second pivotal handle is attached to the top.

6. The paint container of claim 1, wherein the integral handle is formed within the side walls of the body.

7. The paint container of claim 1, further comprising a paint within an interior of the body.

8. A paint container, comprising:

a body having a bottom, a plurality of side walls, and a top;

a threaded raised neck portion located proximate the top, the neck portion being offset from a center of the top of the body and defining an opening;

a cap configured to be secured to the neck portion;

a spout extending upward proximate the top and at least partially surrounded by the neck portion, the spout permitting paint to be poured from the paint container;

a splash guard disposed proximate the spout and not extending beyond an outer periphery of the body, the splash guard being independent of the spout and being external to the raised neck portion;

a handle being pivotally attached to the body at two pivot points defining a pivot line extending through the center of the top of the body; the handle not extending beyond the outer periphery of the body; and a channel located between the neck portion and the spout, wherein paint spilled into the channel is directed into an interior of the body.

9. The paint container of claim 8, further including a channel opening adjacent the channel through which the paint flows back into the container.

10. The paint container of claim 9, wherein the spout is sized to permit entry of at least a two inch brush into the container.

11. The paint container of claim 8, further comprising a second handle formed into one or more of the plurality of side walls.

12. The paint container of claim 8, wherein the splash guard extends upward from the top of the body independent of the spout, the splash guard being external to the cap when the cap is secured to the neck portion, and the spout being covered by the cap when the cap is secured to the neck portion.

13. The paint container of claim 8, wherein the body is constructed of plastic.

14. The paint container of claim 8, wherein the cap is sized to function as a paint holder.

15. The paint container of claim 8, wherein the handle is attached to the top.

16. The paint container of claim 8, wherein the cap includes a periphery having a plurality of finger grip recesses located therein.

17. The paint container of claim 11, wherein the cap includes a periphery having a plurality of finger grip recesses located therein.

18. The paint container of claim 8, further comprising a paint within an interior of the body.

* * * * *